US005167134A

United States Patent [19]

Fučík et al.

[11] Patent Number: 5,167,134

[45] Date of Patent: Dec. 1, 1992

[54] MECHANICAL TAKE DOWN DEVICE

[75] Inventors: Milan Fučík, Kojetice na Morave; Miroslav Chromý, Rokytnice nad Rokyt.; Jirí Pohorilský, Trebíc, all of Czechoslovakia

[73] Assignee: Elitex Liberec, Czechoslovakia

[21] Appl. No.: 742,451

[22] Filed: Aug. 5, 1991

Related U.S. Application Data

[63] Continuation of Ser. No. 492,090, Mar. 12, 1990.

[51] Int. Cl.[5] ..... D04B 15/88

[52] U.S. Cl. ..... 66/147

[58] Field of Search ..... 66/147, 150, 153

[56] References Cited

U.S. PATENT DOCUMENTS

| | | | |
|---|---|---|---|
| 1,307,358 | 6/1919 | Houseman | 66/153 |
| 2,521,258 | 9/1950 | Semotán | 66/150 |
| 2,644,335 | 7/1953 | Hanes, Jr. et al. | 66/150 |
| 2,972,875 | 2/1961 | St. Pierre | 66/150 |
| 3,430,464 | 3/1969 | Mazzi | 66/153 |
| 4,576,019 | 3/1986 | Keel et al. | 66/147 |

FOREIGN PATENT DOCUMENTS

| | | | |
|---|---|---|---|
| 649846 | 9/1937 | Fed. Rep. of Germany | 66/150 |
| 432233 | 7/1935 | United Kingdom | 66/147 |
| 1577474 | 10/1980 | United Kingdom . | |
| 2110725 | 6/1983 | United Kingdom . | |

*Primary Examiner*—Werner H. Schroeder
*Assistant Examiner*—John J. Calvert
*Attorney, Agent, or Firm*—Ostrolenk, Faber, Gerb & Soffen

[57] ABSTRACT

A mechanical take down device in a circular, particularly double cylinder knitting machine. The device includes two circular parts, one being full and solid and fitting into the other part, while the fabric passes between them. One of the parts has a screw-threaded surface and the neighboring surface of the other part is circular in shape and its slant equals that of the screw-threaded surface. One of the parts does not rotate, while the other rotates and is coupled with the needle cylinder.

17 Claims, 2 Drawing Sheets

MECHANICAL TAKE DOWN DEVICE

This is a continuation of application Ser. No. 07/492,090 filed on Mar. 12, 1990.

The invention relates to a mechanical take down device in a circular knitting machine, particularly a double cylinder knitting machine.

It is known that different types of mechanical take down devices are used in double cylinder circular knitting machines for the production of sock goods to take down the goods.

Machines are known, as described in Czechoslovak Author's Certificate 185,999, where the take down mechanism comprises vertically movable working elements arranged in a circle. Vertical movement of working elements is controlled by a stationary cam and springs. Working ends of said elements are made in the form of flexible blades. Said device operates reasonably reliably, except for jacquard take down, where bars are sometimes visible. Said bars originate due to uneven take down between neighbouring working elements.

The above mentioned disadvantage is eliminated by a take down device described e.g. in Czechoslovak Author's Certificate 221,149, where there is a take down pin which catches-up the fabric during welt knitting and during the course of further knitting it takes it down due to the action of a pneumatic mechanism. Said device practically eliminates longitudinal bars, but it is relatively complicated, takes-up space and requires the supply of pressure air into the machine. A further disadvantage is that it does not permit the knitting of panties due to the lift of the device. The lift may be performed in two parts entailing the added time over knitting one product.

When knitting fabric of a low density, i.e. with high extensibility, wrinkling of the fabric takes place.

The object and function of the present invention is to eliminate the above mentioned disadvantages, in, that the device comprises two coaxially arranged circular parts with the fabric passing between them. The surface of one of said parts coming into contact with the fabric is provided with a screw-like surface and one of the parts is arranged non-rotatably.

The advantage of the invention is that the device is very simple and not-demanding in operation and in servicing. Due to the fact that the device acts around the whole periphery of the fabric by a continuous pull, it entirely eliminates creation of longitudinal bars and practically enables knitting of infinitely long products. Also, it even replaces a roller take down. Moreover, it smooths-up the fabric surface and the fabric quality is better. The device does not need to be adjusted and there is practically no wear, which guarantees its long service life. Faults due to the function are also entirely eliminated. The device can operate like upper or lower take down elements.

Figure 1:
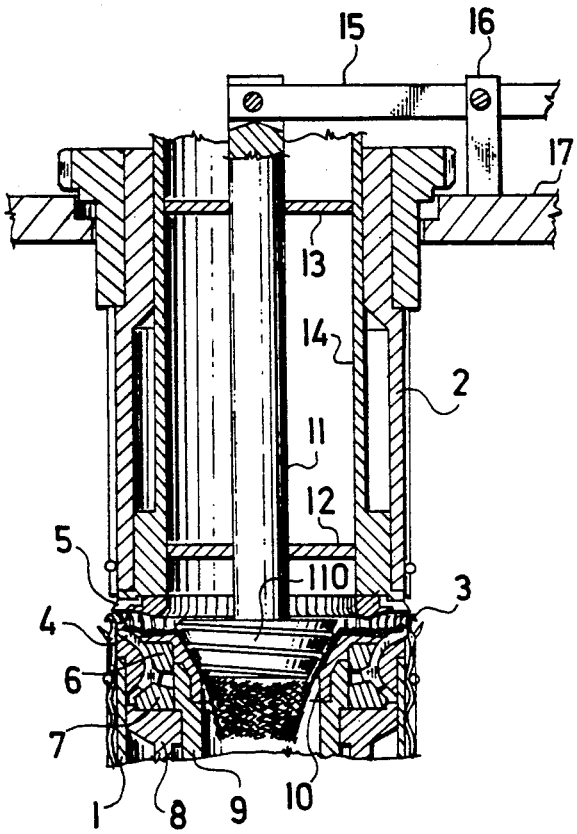
Figure 2:
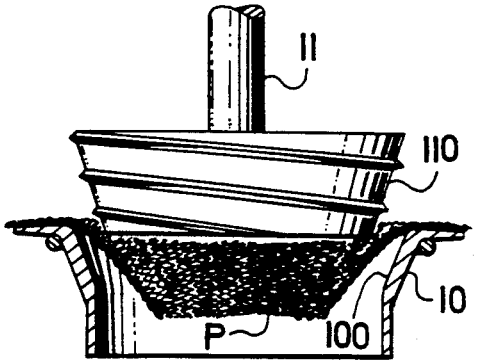
Figure 3:
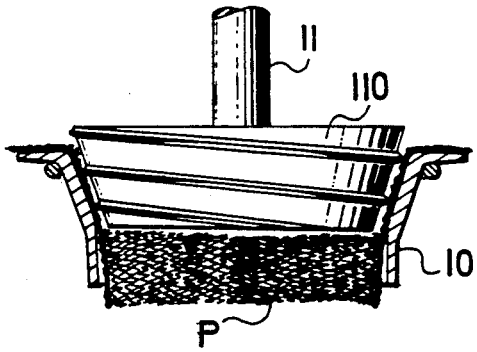
Figure 4:
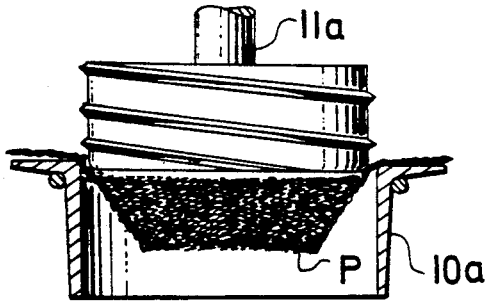
Figure 8:
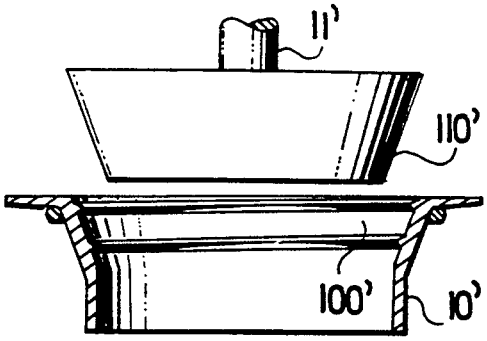
Figure 5:
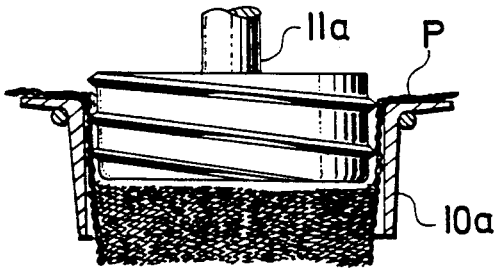
Figure 9:
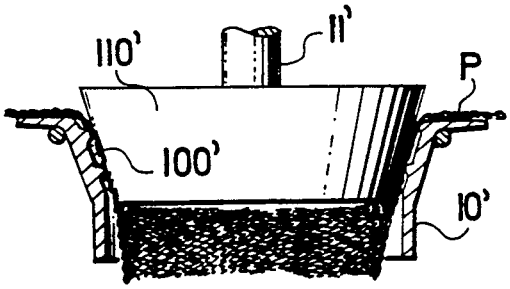
Figure 6:
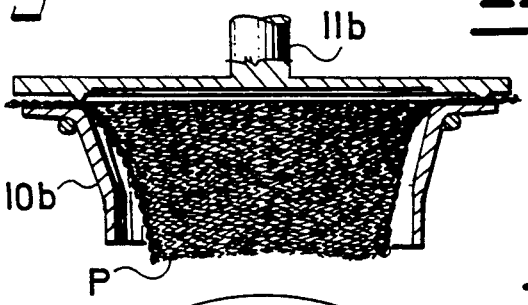
Figure 7:
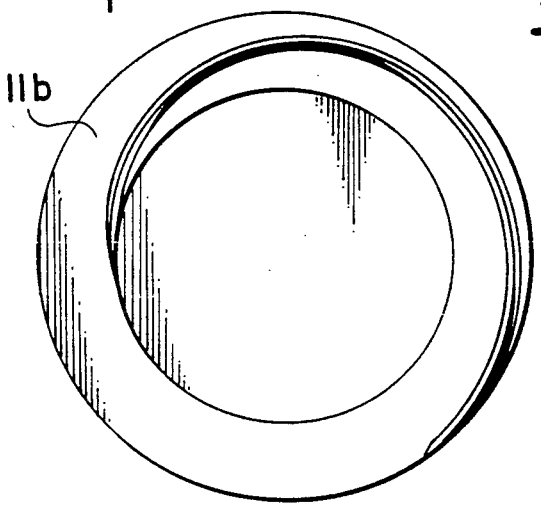

The foregoing and other objects of this invention will become apparent in the following description and drawings in which:

FIG. 1 is a schematic arrangement of the take down device in operational position in a double bed circular knitting machine, FIG. 2 is a detail of both parts of the take down in non-operational position, FIG. 3 is a detail of both parts of the take down in operational position, FIG. 4 is a detail of both parts of the take down in non-operational position, where the working surfaces are formed on the base of cylindrical surfaces, FIG. 5 shows a structure like that of FIG. 4, but the parts are in operational position, FIG. 6 is a view of another embodiment of both parts in operational position, FIG. 7 is an illustration of the screw-like surface of the upper part according to FIG. 6 when viewed from below, FIGS. 8,9 are similar to FIGS. 2 and 3, but the screw-like surface is on the second part.

A known double cylinder circular knitting machine for the production of sock goods is provided with a lower and upper needle cylinder, 1,2, where there are located double-head needles 3 and further, known, (not shown) jacks to control needles 3. In order to form the stitches, the machine is further provided with knock over sinkers 4 in the lower needle cylinder 1 and with stationary presser sinkers 5 in the upper needle cylinder 2. Knock over sinkers 4 are controlled by stationary cam rings 6,7 fixedly arranged on a non-rotary tube 8.

The machine is equipped with a mechanical take down device comprising the following parts. In the lower needle cylinder 1 there is a part 10 of a funnel-like shape with a central opening for fabric passage fixedly arranged on an internal rotating take down tube 9. In the upper needle cylinder 2 there is arranged an axially shiftable part 11, the working part of which is formed like an external, conical, screw-like interfacing surface 110. The parts 10 and 11 fit into each other, and the slope of internal conical interfacing surface 100 /FIG. 2/ of part 10 corresponds with the conical screw-like surface 110. Both parts 10 and 11 are arranged coaxially, while part 11 is located axially shiftably in rings 12,13 which are fixedly arranged in an internal tube 14 of the upper needle cylinder 2, while the tube 14 rotates with the needle cylinder 2. At the upper end of part 11 is arranged a lever 15 located swingably in a stand 16 on an upper flange 17 of the machine. The other arm of the lever 15 is controlled by the machine control drum through a (not shown) kinematic transmission.

Operation of the above mentioned device is as follows. At the beginning of knitting the fabric, i.e. of the welt, part 11 is lifted so that the device is out of operation. Fabric P grows longer, while it contracts toward the center due to laying of elastic thread. After the knitting of the welt is finished, part 11 /FIG. 3/ is lowered by a command from the control drum. Fabric P is pressed by conical screw-like surface 110 onto the internal conical surface 100. Pressure of part 11 causes entrainment of fabric P by rotating part 10. Due to the rotation, the fabric P is in fact screwed into the surface of conical screw-like surface 110 and it is thus in fact tensioned and taken down from the needles 3. After knitting is finished, part 11 is lifted by a command from the control drum and the fabric is cast off the needles 3.

Various modifications can be performed within the scope of the invention. The operation of parts 10 and 11 can proceed in opposite sequence. The upper part 11' /FIG. 8/ is provided with a conical surface 110' and the lower part 10' with a screw-like conical surface 100'. In case of fit of the part 11' into the part 10' /FIG. 9/, the fabric is tensioned and taken down by the part 10'. Another modification representing no change in the principle of the solution consists in that the rotary location is changed. The lower part 10 or 10' is arranged non-rotatably and the upper part 11, 11' is arranged as driven.

Further, the surfaces by which the parts fit into each other do not need to be conical, but they may be for example of a cylindrical shape, as shown by parts 11*a*, 10*a* in FIGS. 4 and 5, or they may be formed in adjacent plane faces as in parts 11*b*, 10*b* /FIGS. 6 and 7/.

Further, the take down device can be arranged for upper take down so that the part with the opening, for example the part 10 is arranged in the upper needle cylinder, and the full part, for example the part 11, in the lower cylinder. In this case it is possible for the full part in the lower needle cylinder not to be axially shiftable and for the part with the opening for fabric passage to be axially shiftable.

The device according to the invention can be used even in single cylinder knitting machines and also in large diameter knitting machines.

What we claim is:

1. A mechanical take down device in a double cylinder knitting machine, the device comprising:

a first circular part having an end with an axial center opening therein, a second circular part extending into the opening in the first circular part and being coaxial with the first circular part, the first circular part having a respective generally conical first inward surface and the second circular part having a generally conical second outward surface, the first and second surfaces being shaped and placed for contacting the fabric being knitted on the knitting machine, as the fabric passes between the surfaces; one of the first and second surfaces being relatively rotatable with respect to the other; one and only one of the surfaces being screw threaded, having threads which engage and press the fabric against the other of the surfaces when the first and second parts are rotated relatively.

2. The mechanical take down device of claim 1, wherein the second part fits in the opening in the first part.

3. The mechanical take down device of claim 1, wherein the second part extends into the central opening in the first part, the first and second surfaces having respective generally conical surfaces of the same slope for enabling the first and second surfaces to fit against each other.

4. The mechanical take down device of claim 3, wherein the first and second parts are relatively axially shiftable with respect to each other to bring the first and second surfaces together against fabric passing between them.

5. The mechanical take down device of claim 4, wherein the opening in the first part is conically tapered the second part, tapering into the first part.

6. The mechanical take down device of claim 4, wherein the central opening in the first part continues down through the first part away from the second part for defining a continuing passage for the fabric passing between the first and second surfaces.

7. The mechanical take down device of claim 2, further comprising a first needle cylinder and the first part being secured in the first needle cylinder, a second needle cylinder and the second part being secured in the second needle cylinder, the first and second needle cylinders together defining a needle engagement means for engaging the fabric.

8. The take down device of claim 4, wherein the second surface is the screw threaded surface and the first surface is non-threaded.

9. The mechanical take down device of claim 4, wherein the first surface is screw threaded and the second surface is non-screw threaded.

10. The mechanical take down device of claim 4, wherein the first and second surfaces have a diameter such that the screw threads on one of the surfaces substantially press against the other surface.

11. The take down device of claim 1, wherein the second surface is the screw threaded surface and the first surface is non-threaded.

12. The mechanical take down device of claim 1, wherein the first surface is screw threaded and the second surface is non-screw threaded.

13. A mechanical take down device in a double cylinder knitting machine, the device comprising:

a first circular part having an end with an axial center opening therein, a second circular part disposed at the opening in the first circular part and being coaxial with the first circular part, the first circular part having a respective generally conical interface surface and the second circular part having a generally conical second interface surface, the first and second surfaces being shaped and placed for contacting the fabric being knitted on the knitting machine, as the fabric passes between the surfaces; at least one of the first and second surfaces being relatively rotatable with respect to the other; at least one of the surfaces being screw threaded, having threads which engage and press the fabric against the other of the surfaces when the first and second parts are rotated relatively.

14. The mechanical take down device of claim 13, wherein the first and second parts are relatively axially shiftable with respect to each other to bring the first and second surfaces together against fabric passing between them.

15. The mechanical take down device of claim 14, wherein the second surface is screw-threaded and the first surface is non-threaded.

16. The mechanical take down device of claim 14, wherein the first surface is screw-threaded and the second surface is non-screw-threaded.

17. A mechanical take down device in a double cylinder knitting machine, the device comprising:

a first circular part having and end with an axial center opening therein, a second circular part extending into the opening in the first circular part and being coaxial with the first circular part, said second part fitting in the opening in the first part, the first circular part having a respective generally conical first inward surface and the second circular part having a generally conical second outward surface, the first and second surfaces being shaped and placed for contacting the fabric being knitted on the knitting machine, as the fabric passes between the surfaces; at least one of the first and second surfaces being relatively rotatable with respect to the other; at least one of the surfaces being screw threaded, having threads which engage and press the fabric against the other of the surfaces when the first and second parts are rotated relatively;

the mechanical take down device further comprising a first needle cylinder and the first part being secured in the first needle cylinder, a second needle cylinder and the second part being secured in the second needle cylinder, the first and second needle cylinders together defining a needle engagement means for engaging the fabric, one of the first and second parts rotating with a respective needle cylinder, the other of said parts being stationary.

* * * * *